US007661232B2

(12) United States Patent
Smith

(10) Patent No.: US 7,661,232 B2
(45) Date of Patent: Feb. 16, 2010

(54) SYSTEM AND METHOD FOR A SECONDARY WATER DRAINAGE SYSTEM WITH STREET LEVEL LEAK DETECTION

(75) Inventor: Rodney I. Smith, Midland, VA (US)

(73) Assignee: Easi-Set Industries, Inc., Midland, VA (US)

( * ) Notice: Subject to any disclaimer, the term of this patent is extended or adjusted under 35 U.S.C. 154(b) by 529 days.

(21) Appl. No.: 11/426,404

(22) Filed: Jun. 26, 2006

(65) Prior Publication Data

US 2007/0022686 A1 Feb. 1, 2007

Related U.S. Application Data

(60) Provisional application No. 60/694,434, filed on Jun. 28, 2005.

(51) Int. Cl.
*E04B 1/68* (2006.01)
*E02D 19/00* (2006.01)

(52) U.S. Cl. ..... 52/396.04; 52/169.5

(58) Field of Classification Search ..... 52/302.1, 52/641.4, 399, 395, 62, 310, 396.02, 396.04, 52/209, 302.6, 302.7, 169.5, 302.2, 393, 52/394, 393.01, 396.09; 405/36, 43, 45, 405/47; 277/316, 628, 630, 637, 644, 605, 277/646; 14/73.1; 404/47, 67, 74, 68, 69
See application file for complete search history.

(56) References Cited

U.S. PATENT DOCUMENTS 2,103,648 A * 12/1937 Snelling ..... 404/74
2,104,059 A * 1/1938 Snelling ..... 404/34
2,133,059 A * 10/1938 Snelling ..... 404/74
2,247,836 A * 7/1941 Goldbeck ..... 52/270
3,503,311 A * 3/1970 Gagle et al. ..... 404/74
4,075,810 A * 2/1978 Zakrzewski et al. ..... 52/588.1
4,781,004 A * 11/1988 Hartman ..... 52/464
4,782,636 A * 11/1988 Stoakes ..... 52/235
4,924,647 A * 5/1990 Drucker ..... 52/235
5,168,683 A * 12/1992 Sansom et al. ..... 52/396.04
5,277,515 A * 1/1994 Hovis et al. ..... 404/74
5,289,664 A * 3/1994 Rizza et al. ..... 52/302.1
5,749,282 A * 5/1998 Brow et al. ..... 52/235
6,041,556 A * 3/2000 Keller ..... 52/11
6,183,575 B1 * 2/2001 Embelton ..... 156/71
6,823,633 B2 * 11/2004 Ryan ..... 52/302.1
6,997,640 B1 * 2/2006 Hohmann, Jr. ..... 404/67

(Continued)

*Primary Examiner*—Richard E Chilcot, Jr.
*Assistant Examiner*—Andrew J Triggs
(74) *Attorney, Agent, or Firm*—Whitham Curtis Christofferson & Cook, PC

(57) ABSTRACT

A system and method for a secondary water drainage system with street level leak detection positioned between spaced apart prefabricated building panels is disclosed herein. In the space between two adjacent prefabricated building panels, an inner line of caulk is formed from the top to the bottom of the panels. Next, a porous drain strip is positioned adjacent to a first side of the inner line of caulk, also extending vertically from the top to the bottom of the panels. Lastly, an exterior line of caulk if formed adjacent to the porous drain strip extending vertically from the top of the panels to a point just above the bottom of the panels. The porous drain strip is extended through this space formed in the exterior line of caulk and allows the water collected to exit through the same space.

19 Claims, 6 Drawing Sheets

U.S. PATENT DOCUMENTS

2003/0046888 A1* 3/2003 Ryan ..... 52/302.1
2007/0022686 A1* 2/2007 Smith ..... 52/302.1
2007/0151185 A1* 7/2007 Robinson ..... 52/396.04

* cited by examiner

SYSTEM AND METHOD FOR A SECONDARY WATER DRAINAGE SYSTEM WITH STREET LEVEL LEAK DETECTION

CROSS-REFERENCE TO RELATED APPLICATIONS

This application claims priority to the provisional application filed Jun. 28, 2005, having U.S. Provisional Patent Application Ser. No. 60/694,434, and the complete contents of that application are herein incorporated by reference.

BACKGROUND OF THE INVENTION

1. Field of the Invention

The present invention relates to a water drainage and leak detection system for building panels. In particular, the invention is concerned with a system and method for sealing a space between two precast concrete panels while allowing water drainage to occur. The drain strip/weep system allows street level detection of caulking leaks.

2. Background Description

Prefabricated building panels are commonly used in the construction of buildings. These panels can be manufactured using a wide variety of materials. However, prefabricated building panels are preferably composed of concrete (i.e., precast concrete panels), especially if used in the construction of exterior building structures. As is shown in U.S. Pat. No. 5,699,644, a prefabricated building panel is formed of a concrete slab that is connected to a series of reinforcing beams or studs by a plurality of thermally non-conductive projections, which are embedded in the slab. To reinforce these concrete panels, wire mesh or steel beams are either embedded in or attached externally to the concrete panels. These panels are then connected to a steel channel by anchors. The steel channel acts to separate the prefabricated building panel from the wall formed on the interior of the building, as well as to hold insulating material. This invention can be used with conventional building panels of concrete or other materials from 2" to 12" thickness.

In order to construct the exterior perimeter of a building, these panels are "locked" in place by using bolted and welded attachment plates. Outer and inner lines of water sealing material (e.g., caulk) are then used to seal the edges of adjacent panels to prevent water leakage. However, the existing methods of caulking may allow water to penetrate the outer line of caulk due to poor workmanship or deterioration over time. When penetration occurs, it causes water to lay between the lines of caulk under hydrostatic pressure. This causes the water to work its way through an inner layer of caulk and through the interior of the building, resulting in damage to the insulation and other features of the building (e.g., corrosion, short circuits, mold, etc.). Moreover, water-related corrosion and rust formed on the interior of the wall due to water migration from within the two lines of caulk can cause structural damage.

SUMMARY OF THE INVENTION

Accordingly, there is needed a water drainage system for prefabricated building panels that allows water to drain from between the two lines of caulk without causing damage to the interior of the wall system and to facilitate location of any leaks in the exterior line of caulk.

It is an exemplary object of this invention to provide a method for sealing a space between panels while permitting drainage of water that penetrates through a line of water sealing material. It is another object of this invention to provide a wall structure with a water drainage system. It is yet another object of this invention to provide a water shedding seal for adjoining panel structures. It is still yet another object of this invention to provide a leak detection method by isolating each line of caulking, for example 20', on a building and exiting any water through the leak detector drainage device. This device allows for leak detection and will provide the building owner with a 2 to 4 square foot wet spot visible from the street level the day after a driving rain when exterior panels have dried and the leak detector drain device is still draining the caulk joint.

Preferably, the panels are prefabricated wall elements comprised of steel and cement, and are spaced between ½" and ¼" apart. Preferably, an inner backer rod is first placed in the space between the prefabricated panels. The inner backer rod extends longitudinally between the panels. Next, an inner line of a water sealing material (e.g., caulk) is formed extending longitudinally between the panels. A porous drain strip is then positioned adjacent the inner line of water sealing material, also extending longitudinally between the panels. However, the water sealing materials and the porous drain strip can be extended vertically in the case of multistory structures, for example. The porous drain strip is used to act as a channel so water passes through the porous material. However, any porous material (e.g., reticulated foam) that does not absorb or hold liquid can be used within the scope of the invention. An exterior line of water sealing material (e.g., caulk) is then formed adjacent to the porous drain strip extending longitudinally between the panels. Preferably, the inner line of water sealing material and the outer line of water sealing material is a caulk. However, any material that can be used to repel water can be used within the scope of the invention. Further, the material used for the inner and outer lines of water sealing materials can be the same or different. At least one drain tube is preferably located at intervals between the inner and/or outer line of water sealing material to permit water that gathers in the porous drain strip to exit. Further, more than one drain tube can be located longitudinally and vertically in the water sealing materials depending on the height of the structure (e.g., multistory structures). Preferably, the drain spout or tube is placed through the outer layer of water sealing material to control the direction of the exiting water and facilitate locating any leak.

As previously discussed, existing methods of caulking may allow water to penetrate the outer line of caulk due to poor workmanship or deterioration over time. With the present invention, when a crack or other deterioration occurs in the caulk, or other type of water sealing material, water passes through the porous drain strip. The porous drain strip is designed to not absorb or otherwise hold water. Rather, the porous drain strip directs the water through its pores and out the baffled weep tube located in the outer line of the water sealing material. This allows several quarts of water to drain per hour and is not as prone to blockage from insect intrusion as other drainage systems. Moreover, because water can drain quickly, hydrostatic pressure between the lines of water sealing material is prevented, thus eliminating water damage to the building insulation as well as the building exterior. Furthermore, the porous drain strip is designed to circulate air through the channel ensuring fast drying, thus preventing mold and mildew.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS OF THE INVENTION

Figure 1:
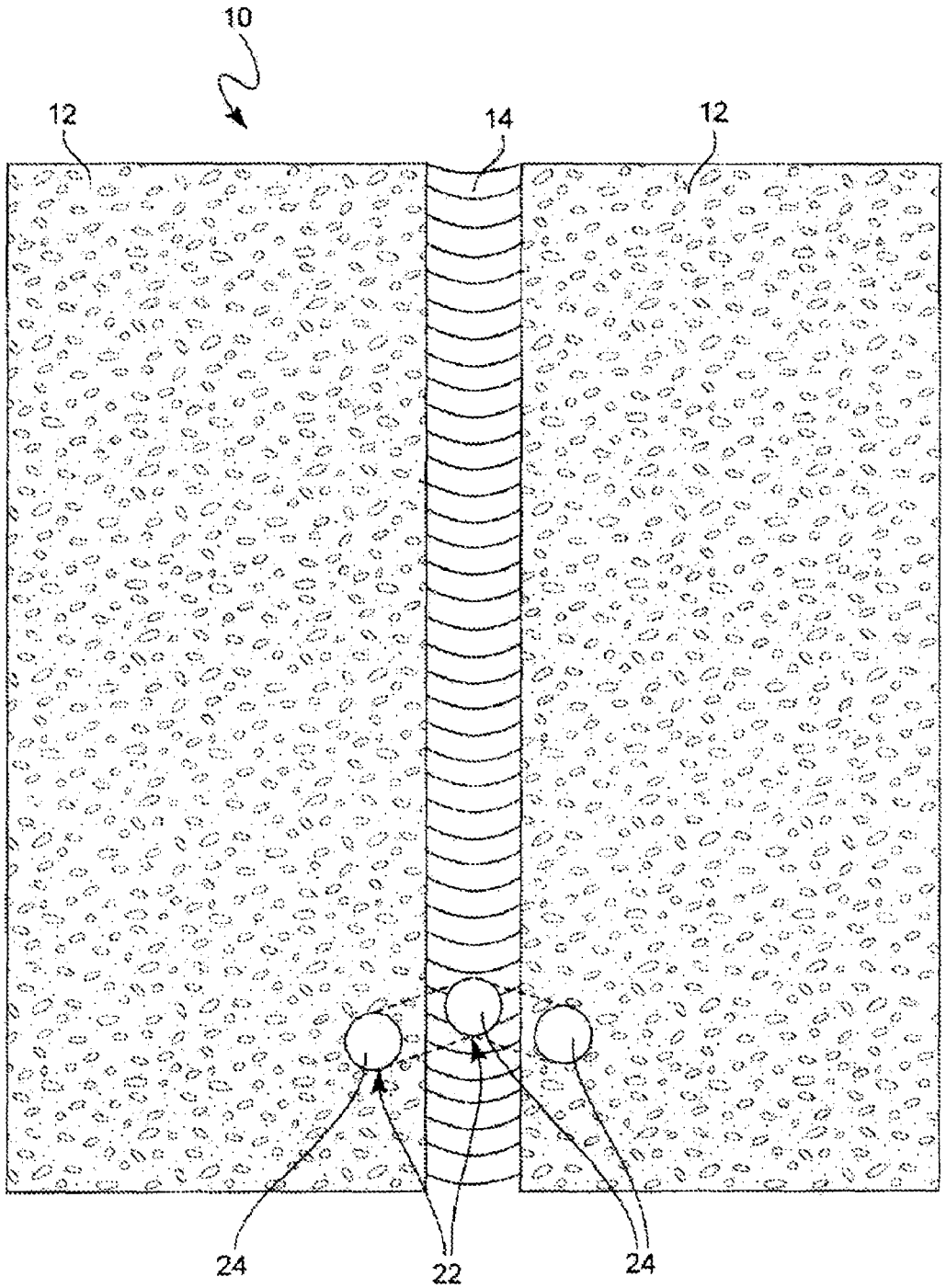
FIG. 1 is a front view of the water drainage and leak detection system of the present invention.
Figure 2:
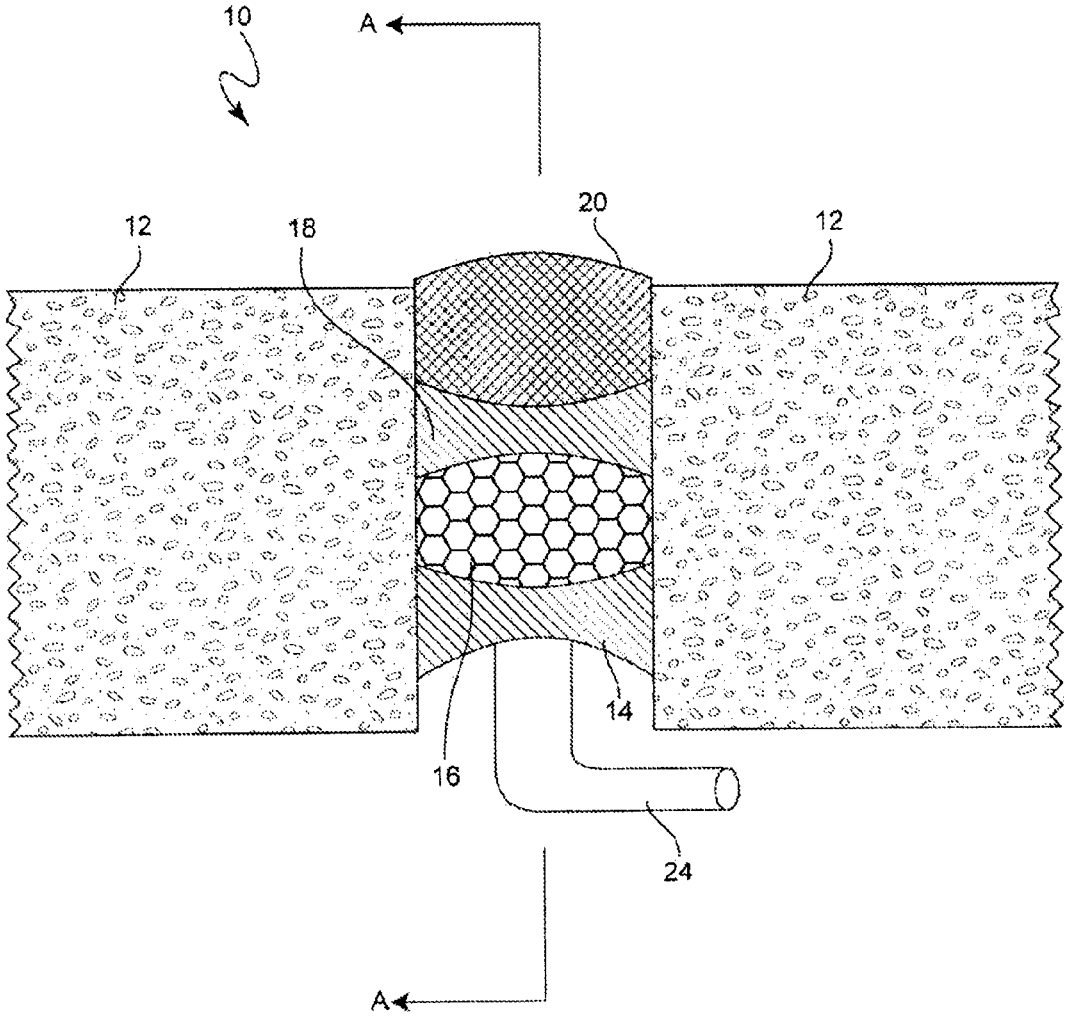
FIG. 2 is a broken and enlarged top view of the water drainage and leak detection system of the present invention.
Figure 4:
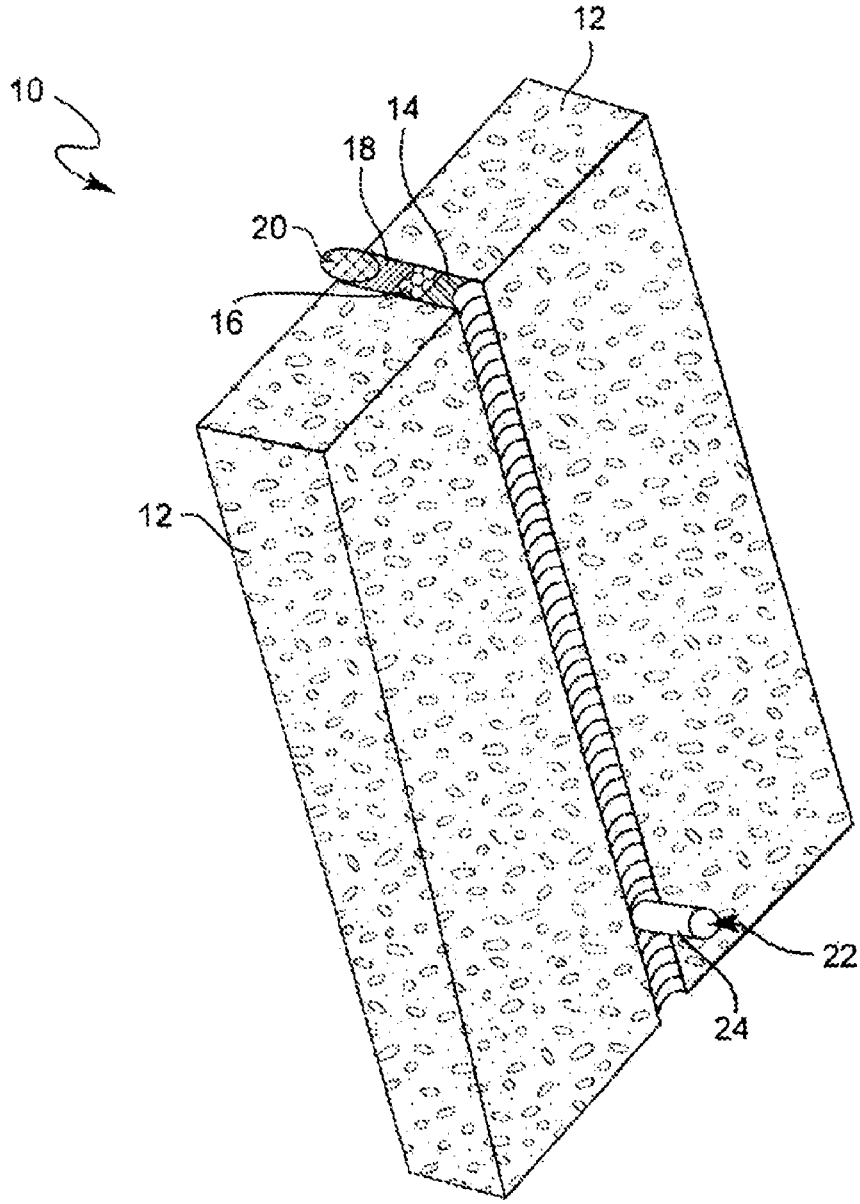
FIG. 4 is an isometric view of two prefabricated panels connected by the water drainage and leak detection system of the present invention.

Referring now to the drawings, and more particularly to FIGS. 1, 2 and 4, there are shown front, top and isometric views, respectively, of the water drainage system 10 according to the present invention. The water drainage system 10 is comprised of an outer layer of water sealing material 14, a porous drain strip 16, and an inner layer of water sealing material 18. Preferably, an inner backer rod 20 (or backer rod) is used to assist in making a sealed penetration.

The panels 12 are spaced, preferably, between ½" and ¾" apart. However, any practical spacing between the panels can be used within the scope of the present invention. Once the panels 12 are spaced at the desired location, the backer rod 20 is, preferably, first placed between the panels 12 to ensure that the inner layer of water sealing material 18 makes a sufficient seal between the panels 12.

Next, the inner layer of water sealing material 18 is formed between the panels 12 extending longitudinally between the panels 12. A porous drain strip or channel 16 is then positioned adjacent the inner layer of water sealing material 18 that is not adjacent to the backer rod 20. Like the inner layer of water sealing material 18, the porous drain strip 16 extends longitudinally between the panels 12. Although the Figures show the use of a porous drain strip or channel, any type of porous material that does not absorb or hold water (e.g., reticulated foam) may be used within the scope of the present invention. Finally, an outer layer of water sealing material 14 is formed adjacent to the other side of the porous drain strip 16. Accordingly, the porous drain strip 16 is held in place by both layers of water sealing material 14, 18.

Figure 3:
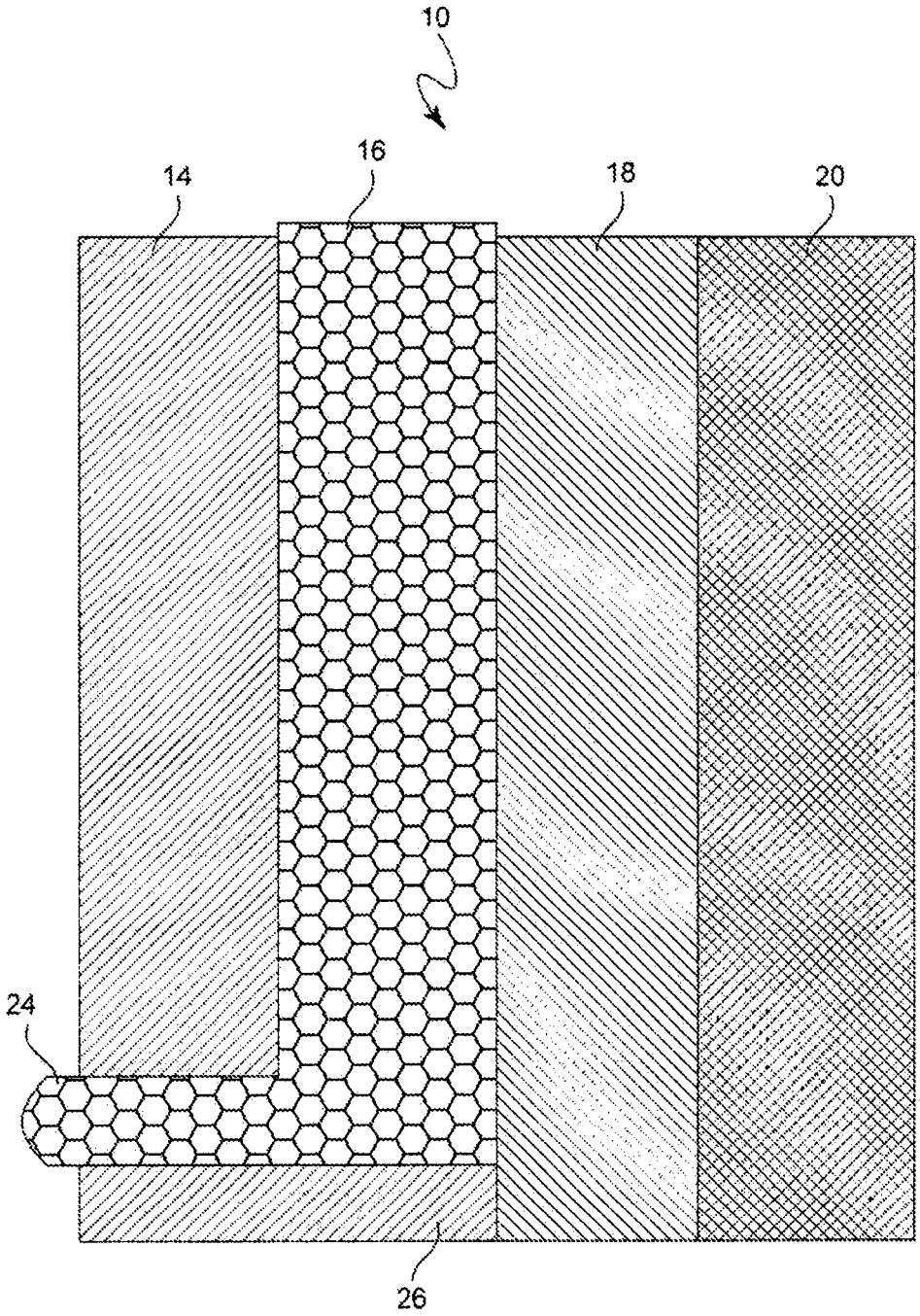
FIG. 3 is a sectional view of line A-A in FIG. 2 of the water drainage and leak detection system of the present invention.
Figure 5:
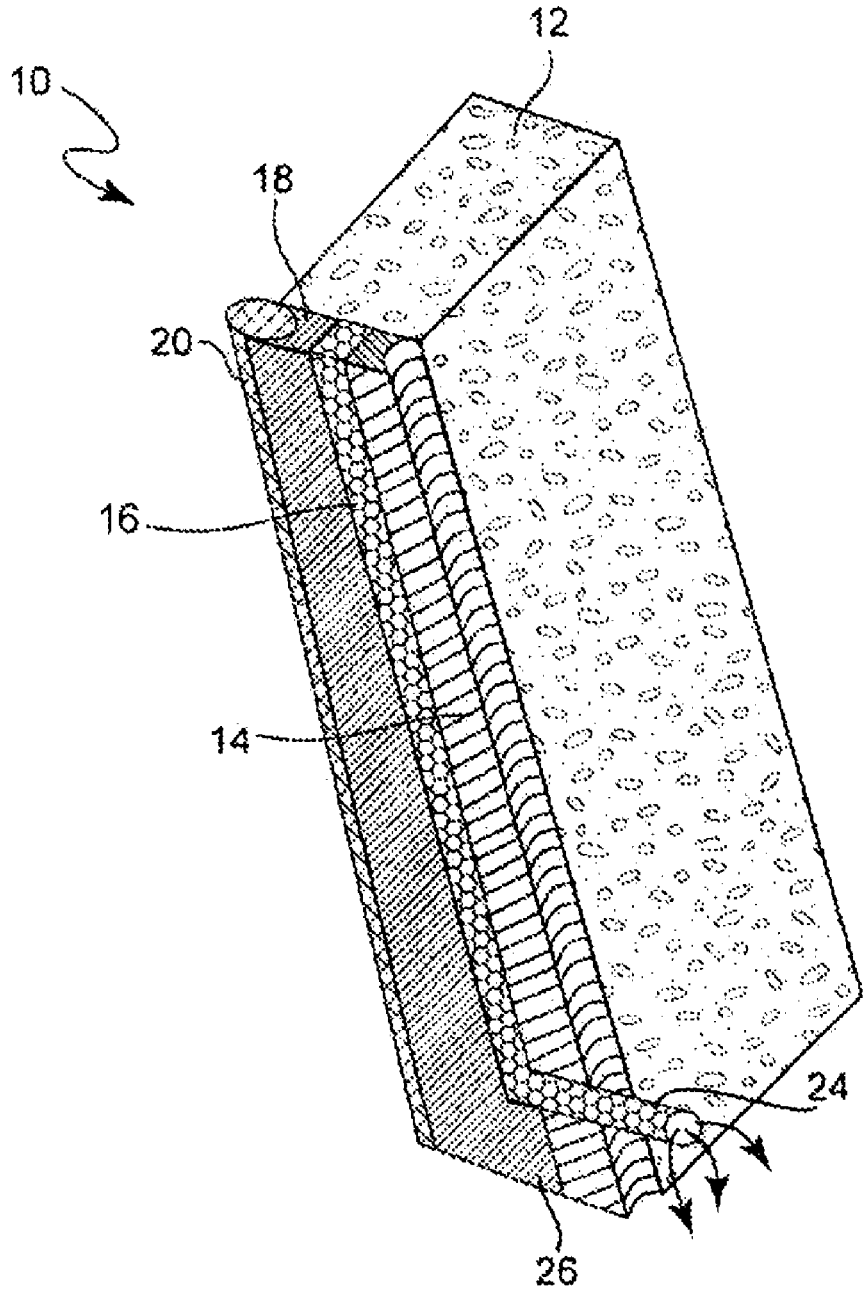
FIG. 5 is an isometric view of the water drainage and leak detection system formed at one side of a prefabricated panel.

Referring now to FIGS. 3 and 5, there are shown sectional views of a water drainage system 10 of the present invention. As is shown, the outer layer of water sealing material 14 extends longitudinally between the panels 12 to a point just above the bottom of the panels 12 to form an exit 22. A drain spout or weep tube 24 is placed or created in the exit 22. The drain spout 24 can be straight or baffled at a 90° angle (shown in FIG. 2, this configuration allowing obvious wetting of the panels 12). The porous drain strip 16 towards the bottom of the panels 12 is extended through the drain spout 24. While the Figures show only one opening 22 at the bottom of the outer layer of water sealing material 14, more than one opening can be formed longitudinally along the inner or outer layer of water sealing material 14, 18 within the scope of the present invention. Further, a caulk dam 26 may be formed beneath the porous drain strip 16 to connect the outer and inner layers of water sealing material 14, 18. The caulk dam 26 assures that water that travels through the porous drain strip 16 drains through the exit 22 and not to the bottom of the wall structure. Accordingly, when water penetrates the inner and/or outer layer of water sealing material 14, 18, it flows through the porous drain strip 16 and out the exit 22 via the drain spout 24, thus eliminating problems associated with hydrostatic pressure. In addition, the porous drain strip 16 allows air to circulate thus ensuring fast drying, as well as mold and mildew prevention. Furthermore, the water that exits through the drain spout 24 will create a damp area on the panel 12, thus facilitating leak detection.

Figure 6:
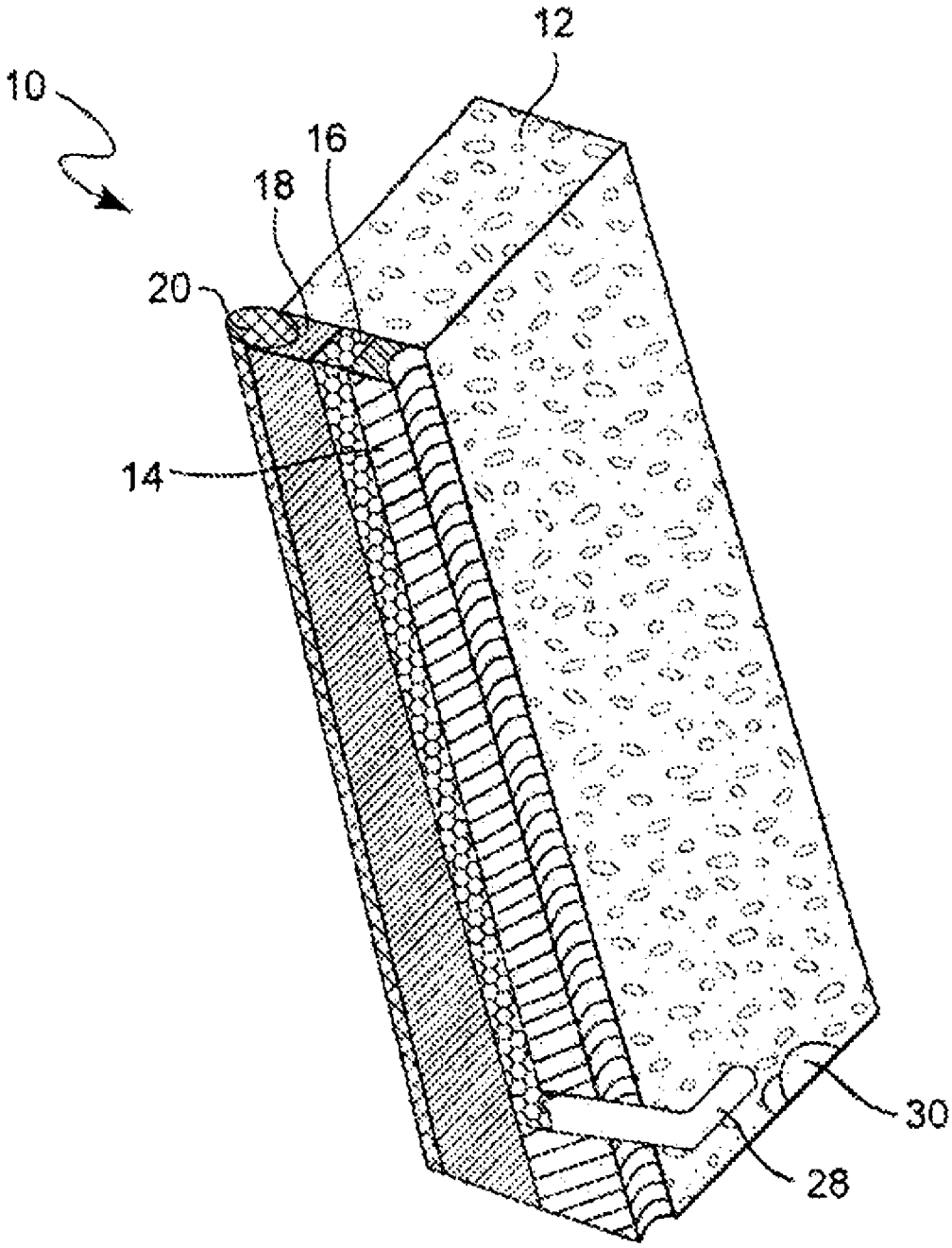
FIG. 6 is an isometric view of the water drainage and leak detection system formed at one side of a prefabricated panel according to an alternative embodiment of the present invention.

Referring now to FIG. 6, there is shown an alternative embodiment of the water drainage system 10 of the present invention. The drainage system 10 is formed as described above; however, the porous drain strip 16 towards the bottom of the panels 12 is placed in only one end portion of a metal drain spout or baffled weep tube 28. The other end portion of the drain spout or tube 28 is extended through the exit 22. The drain spout 28 controls the exit direction of the water that flows through the porous drain strip 16. When the tip end of the drain spout 28 is bent towards the panel 12, drained water leaves an obvious wet spot 30 on the panel, thus allowing for street level leak detection.

While the invention has been described in terms of its preferred embodiments, those skilled in the art will recognize that the invention can be practiced with modification within the spirit and scope of the appended claims.

I claim:

1. A method for sealing a space between two panels, comprising the steps of:

forming an inner line of water sealing material in the space between said two panels, said inner line of water sealing material extending longitudinally between said two panels;

positioning a porous drain strip adjacent to a first side of said inner line of water sealing material, said porous drain strip extending longitudinally between said two panels; and forming an exterior line of water sealing material in the space between said two panels and adjacent to said porous drain strip, wherein said outer line of water sealing material has at least one opening that permits water in said porous drain strip to exit from between said inner line of water sealing material and said outer line of water sealing material.

2. A method for sealing a space between two panels in accordance with claim 1, further comprising the step of positioning an inner backer rod adjacent to a second side of said inner line of water sealing material, said inner backer rod extending longitudinally between said two panels.

3. A method for sealing a space between two panels in accordance with claim 1, further comprising a step of positioning a baffled weep tube in said at least one opening.

4. A method for sealing a space between two panels in accordance with claim 1, wherein said two panels are spaced between ½" and ¾" apart.

5. A method for sealing a space between two panels in accordance with claim 1, wherein said inner line of water sealing material and said outer line of water sealing material can be the same or different.

6. A method for sealing a space between two prefabricated panels in accordance with claim 1, wherein said at least one of said inner line of water sealing material and said outer line of water sealing material is a caulk.

7. A wall structure, comprising:

at least two adjacent panels;

an inner line of water sealing material positioned in a space between said at least two adjacent panels, said inner line of water sealing material extending longitudinally between said two adjacent panels;

a porous drain strip positioned adjacent to a first side of said inner line of water sealing material, said porous drain strip extending longitudinally between said at least two adjacent panels; and an outer line of water sealing material positioned adjacent to said porous drain strip, said outer line of water sealing material extending longitudinally between said at least two adjacent panels, wherein at least one opening is formed in said outer line of water sealing material that permits water in said porous drain strip to exit from between said inner line of water sealing material and said outer line of water sealing material.

8. A wall structure in accordance with claim 7, wherein a baffled drain spout is positioned in said at least one opening formed in said outer line of water sealing material.

9. A wall structure in accordance with claim 7, wherein said at least two adjacent panels are spaced between ½" and ¾" apart.

10. A wall structure in accordance with claim 7, wherein said inner line of water sealing material and said outer line of water sealing material can be the same or different.

11. A wall structure in accordance with claim 7, wherein said at least one of said inner line of water sealing material and said outer line of water sealing material is a caulk.

12. A wall structure in accordance with claim 7, wherein said at least two adjacent panels are prefabricated wall elements comprised of steel and cement.

13. A water shedding seal for adjoining panel structures, comprising:

a porous drain strip extending longitudinally or vertically between a pair of spaced apart panel structures;

inner and outer water sealing materials positioned on opposite sides of said porous drain strip and extending longitudinally between said pair of spaced apart panel structures; and at least one opening in at least one of said inner and outer water sealing materials which permits water in said porous drain strip to exit from between said inner and outer water sealing materials.

14. The water shedding seal of claim 13, further comprising a drainage device positioned in said at least one opening, said drainage device extending from said porous drain strip through said at least one opening.

15. The water shedding seal of claim 14, wherein said drainage device is a baffled 90° weep tube.

16. The water shedding seal of claim 14, wherein said drainage device is oriented in a preselected direction to direct water from said porous drain strip out said at least one opening along said preselected direction.

17. The water shedding seal of claim 13, wherein said inner and outer water sealing materials can be the same or different.

18. The water shedding seal of claim 13, wherein at least one of said inner and outer water sealing materials is a caulk.

19. A wall structure in accordance with claim 8, wherein said baffled drain spout has a tip end portion bent towards at least one of said at least two adjacent panels.

* * * * *